US007228633B2

(12) United States Patent
Ryan

(10) Patent No.: US 7,228,633 B2
(45) Date of Patent: Jun. 12, 2007

(54) SABER

(76) Inventor: Peter M. Ryan, Sylvan Hill, 5 Lanamer Ct., Randallstown, MD (US) 21133

( * ) Notice: Subject to any disclaimer, the term of this patent is extended or adjusted under 35 U.S.C. 154(b) by 112 days.

(21) Appl. No.: 10/789,342

(22) Filed: Mar. 1, 2004

(65) Prior Publication Data

US 2005/0188549 A1 Sep. 1, 2005

(51) Int. Cl.
*B26B 9/00* (2006.01)
*A63B 15/00* (2006.01)

(52) U.S. Cl. ..... 30/346; 463/47.2; 463/47.4

(58) Field of Classification Search ..... 30/346; D22/118, 117; 463/47.1–47.7; 294/61, 74; D8/DIG. 5; 135/65, 66, 81; D3/5–17; 446/473; 434/247, 11

See application file for complete search history.

(56) References Cited

U.S. PATENT DOCUMENTS

| | | | | | |
|---|---|---|---|---|---|
| 411,705 | A | * | 9/1889 | Adams | 463/47.4 |
| 436,891 | A | | 9/1890 | Deunerlohr | |
| 442,470 | A | * | 12/1890 | Willeford | 463/47.4 |
| 443,263 | A | * | 12/1890 | Smith | 463/47.4 |
| 769,880 | A | * | 9/1904 | Trout | 463/47.4 |
| 822,456 | A | | 6/1906 | Jones | |
| D56,764 | S | | 12/1920 | Pease | |
| 1,774,691 | A | * | 9/1930 | Anderson | 30/346 |
| 1,823,407 | A | * | 9/1931 | Potter | 463/47.4 |
| D114,396 | S | * | 4/1939 | Guerra | D8/DIG. 5 |
| 2,266,606 | A | * | 12/1941 | Jones | 463/47.4 |
| 2,566,112 | A | | 8/1951 | Barnard | |
| 2,631,366 | A | * | 3/1953 | Anderson et al. | 30/353 |
| 2,803,087 | A | * | 8/1957 | Zalkind | D7/683 |
| 3,035,344 | A | * | 5/1962 | Brown | 30/346 |
| 3,084,433 | A | | 4/1963 | Kimmel | |
| 3,845,798 | A | * | 11/1974 | Palumbo | 30/308.1 |
| 4,495,698 | A | * | 1/1985 | Gerber, Jr. | 30/357 |
| 4,655,456 | A | * | 4/1987 | Chen Dai | 463/47.2 |
| 4,752,076 | A | * | 6/1988 | Gelinas, Jr. | 273/109 |
| 4,817,942 | A | * | 4/1989 | Begon | 463/47.1 |
| 4,920,648 | A | * | 5/1990 | Jones | D22/118 |
| 4,949,966 | A | * | 8/1990 | Bopp | 463/47.4 |
| 5,174,756 | A | * | 12/1992 | Taylor | 446/473 |
| D333,692 | S | * | 3/1993 | Parsons | D22/117 |
| 5,322,277 | A | * | 6/1994 | Paul et al. | 463/47.1 |
| 5,330,181 | A | * | 7/1994 | Wong | 30/295 |
| 5,494,283 | A | * | 2/1996 | Harris | 463/47.6 |
| D391,336 | S | * | 2/1998 | Cecilio | D22/117 |
| D451,571 | S | * | 12/2001 | Barker, II | D22/118 |
| 6,497,619 | B2 | * | 12/2002 | Dowdy et al. | 463/47.2 |
| D473,624 | S | | 4/2003 | Rae | |
| 6,643,114 | B2 | * | 11/2003 | Stethem | 463/47.3 |
| 6,791,816 | B2 | * | 9/2004 | Stethem | 463/47.4 |

(Continued)

OTHER PUBLICATIONS

The Bud K Catalog, Early Fall 2003, p. 47.*

*Primary Examiner*—Jason Prone

(57) ABSTRACT

For use as a law enforcement weapon, a saber is provided having an elongated blade and a hilt affixed to one end thereof The blade has a triangular cross section including a pair of concave sides converging to a sharp common edge. The third side in opposed relation to the sharp edge is convex The blade is tapered along its length from the hilt end to a point. The handle is oval-shaped, conducive to orientation using the convex side of the blade in a battering mode or the sharp edge in a slashing mode.

11 Claims, 1 Drawing Sheet

U.S. PATENT DOCUMENTS 6,837,896 B2 * 1/2005 Matsutani et al. ..... 30/346
D520,733 S * 5/2006 Siteman ..... D22/117
2004/0093742 A1 * 5/2004 Holler ..... 30/356

* cited by examiner

SABER

FIELD OF THE INVENTION

The present invention relates generally to law enforcement and particularly to a new weapon of intermediate lethality that will significantly improve the offensive and defensive capabilities of police officers.

BACKGROUND OF THE INVENTION

Standard equipment for police officers typically includes a sidearm (pistol) and a baton. Police officers frequently have to confront miscreants willing and able to launch assaults on officers that have only drawn their batons. Often police officers sustain serious injury or even death from such assaults. Yet, if the assailants are unarmed, mentally ill, or enraged by a domestic situation, using lethal force by shooting them often results in public backlash. However, reluctance to use the force necessary to subdue such violent assailants risks harm to police. Even if such assailants are armed with knives, broken bottles, and the like, use of the more lethal force of a pistol shot to subdue them may result in censure and lawsuits.

Quelling rioters is another situation where police use of firearms is unacceptable, even though some may attempt to goad police into using lethal force, hoping to create martyrs that will further their cause.

It would be a major benefit to law enforcement if police officers had a weapon of intermediate lethality, i.e., more lethal than a baton, but less lethal than a firearm. Such a weapon should require little maintenance, require minimum training, be inexpensive, highly portable, and at all times immediately at hand.

SUMMARY OF THE INVENTION

In accordance with the present invention, there is provided a law enforcement weapon of intermediate lethality that can be carried by police officers for ready use to subdue miscreants.

This weapon is in the form of a saber comprising an elongated blade of generally triangular cross section, having first and second concave sides converging from respective first edges to a common sharp edge, and a third side joining the first edges of the first and second sides, the first, second and third sides being tapered along their lengths to provide a tip at a first end of the blade. A hilt is fixed to a second end of the blade and comprises a handle and a guard.

The invention accordingly comprises the features of construction, combination of elements, and arrangement of parts, all as described hereinafter, and the scope of the invention will be indicated in the claims.

BRIEF DESCRIPTION OF THE DRAWINGS

For a full understanding of the nature and aspects of the present invention, reference may be had to the following Detailed Description taken in conjunction with the accompanying drawing, in which.

DETAILED DESCRIPTION

Figure 1:
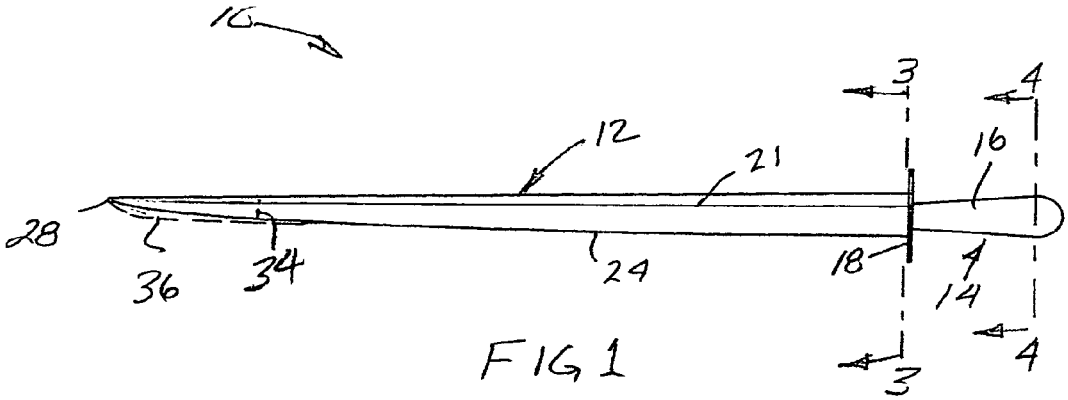
FIG. 1 is a side view of a saber structured in accordance with the present invention.
Figure 2:
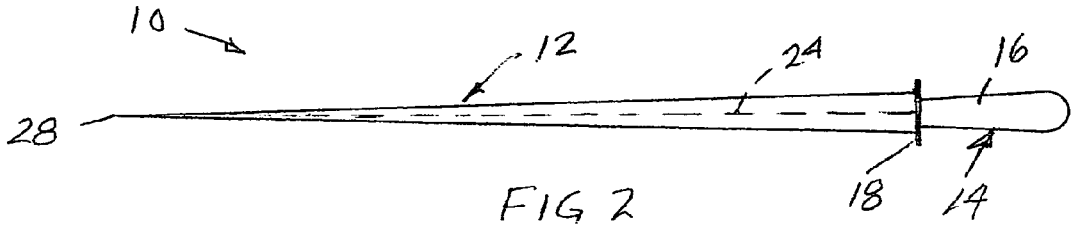
FIG. 2 is a top view of the saber of FIG. 1.

The law enforcement weapon of the present invention is in the form of a saber, generally indicated at 10 in FIGS. 1 and 2. This saber comprises an elongated blade, generally indicated at 12 and a hilt, generally indicated at 14, which is affixed to a tanged end extension (not shown) of the blade in various ways well known in the art. The hilt 14 includes a handle 16 separated from the blade by a guard 18.

Figure 3:
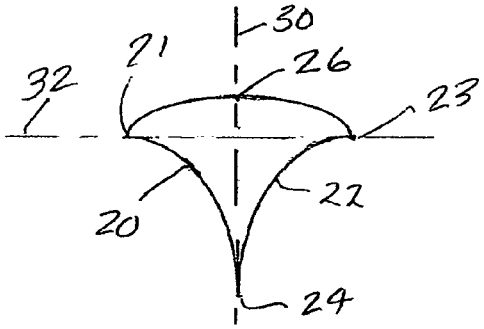
FIG. 3 is a sectional view taken along line 3—3 of FIG. 1.

As seen in FIG. 3, blade 12 has a generally triangular cross section, including, in the orientation shown, two concave sides 20 and 22 converging from respective edges 21 and 23 downwardly to a sharp edge 24 and a third convex upper side 26 extending from edges 21 and 23 and providing the heel of the blade. From hilt 14, the blade sides are tapered along the length of the blade 12 to a point 28, as seen in FIGS. 1 and 2.

Figure 4:
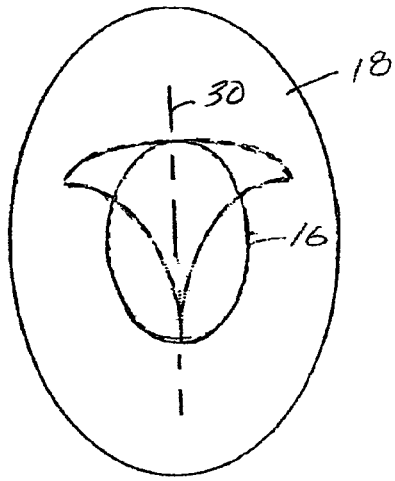
FIG. 4 is a sectional view taken along line 4—4 of FIG. 1.

As seen in FIG. 4, handle 16 has an oval cross section with its long diameter aligned with a vertical axis 30 of the blade bisecting an angle defined by edges 21, 23, and 24. This oval handle cross section orientation provides a key for properly gripping the handle to wield the saber 10 in either a slashing mode using sharp edge 24 or a battering mode using convex side 26.

The length of blade 12 should be at least 20 inches. In practice, the blade would be in the range of 24 to 48 inches. Representative blade cross section dimensions are, at the hilt, on the order of 1.5 inches along vertical axis 30 from edge 24 to convex side 26 and on the order of 1.5 inches along a horizontal axis 32 between concave side edges 21 and 23.

The saber of the present invention may be provided in two versions, as a short-bladed weapon, 24 to 36 inches from hilt to tip, for patrol duty and a long-bladed weapon, 30 to 48 inches from hilt to tip, for riot duty. The shorter blade length of the patrol version is better suited for use in close quarters, such as a room, and can be wielded without being encumbered by walls, furniture, and bystanders. In most cases, a police officer should be able to hold a miscreant at bay with the saber while remaining beyond the reach of knives, clubs, and other items used as weapons. The miscreant should then recognize that the officer has the greater reach and hopefully surrender. If he does not surrender, the officer can either batter him into submission with the heal of the saber blade or slash him with the sharp blade edge 24. By virtue of the divergence of the concave sides of the blade, cuts inflected on the miscreant would be largely superficial. If these tactics fail, thrusting the saber to inflict more disabling stab wounds on the miscreant would be used to subdue him While stab wounds can be serious, they are more survivable than bullet wounds.

For riot duty, the long-bladed saber would be used in the same manner to keep rioters at bay and to repel those that attempt to attack police officers by inflicting injuries sufficient to quell the rioter's zeal.

The short-bladed saber may be carried in a belt scabbard, and the long-bladed saber may be slung across an officer's back.

The invention being thus described, it will be apparent that the saber may be varied in numerous ways. For example, to reduce the saber's lethality, the blade tip may be blunted, as indicated in phantom at 34 in FIG. 1. Alternatively, the sharp edge may terminate in a curved knife edge configuration as indicated in phantom at 36. Such variations are not to be regarded as a departure from the spirit and scope of the invention, and all such modifications as would be obvious to one skilled in the art are intended to be included within the scope of the invention.

The invention claimed is:

1. A saber comprising:

and elongated blade of generally triangular cross section having first and second concave sides converging from respective first edges to a common sharp edge and a third convex side joining the first edges of the first and second sides, the first, second, and third sides being tapered along their lengths to a pointed first end of the; and a hilt fixed to a second end of the blade and including a handle and a guard wherein, adjacent the hilt, a distance between the first edges of the first and second sides of the blade is on the order of 1.5 inches.

2. The saber of claim 1, wherein the handle has an oval-shaped cross section with a long diameter bisecting an angle defined by the respective first edges of the first and second sides and the common sharp edge.

3. The saber of claim 2, wherein the blade length ranges from 24 to 48 inches.

4. The saber of claim 1, wherein, adjacent the hilt, a distance between the common sharp edge and a midpoint of the third side of the blade is on the order of 1.5 inches.

5. A saber comprising:

a blade of generally triangular cross section and at least 20 inches in length having first and second concave sides converging from respective first edges to a common sharp edge and a third side joining the first edges of the first and second sides and providing a heel for the blade, the first and second concave sides having deep concavities; and a hilt including a handle and a guard fixed to a first end of the blade wherein, adjacent to the hilt, a distance between the first edges of the first and second sides of the blade is on the order of 1.5 inches.

6. The saber of claim 5, wherein a second free end of the blade is pointed.

7. The saber of claim 5, wherein the blade is tapered along the length thereof to an acute second end.

8. The saber of claim 5, wherein the blade is tapered along its length to a blunted second end.

9. The saber of claim 5, wherein the blade is tapered along its length to a knife edge configuration.

10. The saber of claim 5, wherein the handle has an oval-shaped cross section with a long diameter bisecting an angle defined by the respective first edges of the first and second sides and the common sharp edge.

11. The saber defined in claim 5, wherein, adjacent the hilt, a distance between the common sharp edge and a midpoint of the third side of the blade is on the order of 1.5 inches.

* * * * *